United States Patent [19]

Stone

[11] Patent Number: 4,838,541

[45] Date of Patent: Jun. 13, 1989

[54] AMUSEMENT DEVICE

[76] Inventor: Myron Stone, 614B Gregory Ave., Weehawken, N.J. 07087

[21] Appl. No.: 234,938

[22] Filed: Aug. 22, 1988

[51] Int. Cl.[4] ..... B02C 27/08

[52] U.S. Cl. ..... 272/27 N; 272/8 N; 350/41; 350/42

[58] Field of Search ..... 272/1 R, 8 R, 8 M, 8 N, 272/8 D, 8.5, 27 N; 850/4.1, 4.2; D21/60; 446/487

[56] References Cited

U.S. PATENT DOCUMENTS

| | | | |
|---|---|---|---|
| 1,398,858 | 11/1921 | House | 350/4.1 |
| 2,495,967 | 1/1950 | Hamilton | 446/487 |
| 2,697,380 | 12/1954 | Wyser | 350/4.1 |
| 3,841,730 | 10/1974 | Kabelitz | 350/4.1 |
| 3,923,368 | 12/1975 | Hassel | 350/4.1 |
| 4,040,716 | 8/1977 | Matsubara | 350/4.1 |
| 4,439,002 | 3/1984 | Brown | 350/4.1 |

*Primary Examiner*—David A. Scherbel
*Assistant Examiner*—Richard E. Chilcot, Jr.
*Attorney, Agent, or Firm*—Samuelson & Jacob

[57] ABSTRACT

An amusement device includes a thin strip wound into a coiled configuration and selectively extendable axially into a tubular spiral configuration tapered from a larger end to a smaller end, the strip having a light-reflective arrangement for reflecting light radially inwardly such that upon viewing a patterned target through the tubular spiral configuration, from the larger end toward the smaller end, multiple reflected images of the pattern of the target on the inner periphery of the spiral configuration provide amusing novel optical effects.

14 Claims, 1 Drawing Sheet

AMUSEMENT DEVICE

The present invention relates generally to amusement devices and pertains, more specifically, to an amusement devices for use in connection with a visible patterned target, enabling viewing of the target with novel optical effects.

The market for simple, inexpensive amusement device always has been a wide one, the demand for novel and entertaining devices always having been great. Much effort has been placed on the design and development of new devices to fill the demand. The present invention takes advantage of currently available materials and manufacturing techniques to provide a practical, novel device for the amusement of a wide audience, ranging from ingenuous childred to sophisticated business executives and professionals. As such, the invention has several objects and advantages, some of which may be summarized as: Simple and inexpensive construction providing a high degree of amusement at minimal expense; Attains novel optical effects without structural complexity; Provides versatile tactile manipulations for satisfying the amusement requirements of a wide audience; Provides a compact construction for ease of storage and convenient carrying, yet is erected readily for use; Enables versatility in a unique, aesthetically attractive device for multiple entertaining uses by a wide audience; makes use of commonly available current materials for economy and acceptance; Easily manufactured in large numbers of consistent high quality.

The above objects and advantages, as well as further objects and advantages, are attained by the present invention, which may be described briefly as an amusement device for use in connection with a selected patterned target to enable viewing of the target with novel optical effects, the device comprising: an elongate, thin strip of resiliently flexible material wound into a coiled configuration having a plurality of overlapping turns extending from a radially innermost turn to a radially outermost turn, an inner periphery along the innermost turn of the coiled configuration and an outer periphery along the outermost turn of the coiled configuration, a first end located along the outer periphery of the coiled configuration, and a second end located along the inner periphery of the coiled configuration; the strip having opposite first and second surfaces, the first surface facing radially outwardly and the second surface facing radially inwardly such that upon displacement of the second end of the strip axially relative to the first end of the strip the coiled configuration will be elongated axially into an elongate tubular spiral configuration tapered from a larger diameter end at the outermost turn to a smaller diameter end at the innermost turn; and light-reflective means on the strip for reflecting light radially inwardly such that upon placement of the smaller diameter end adjacent the selected target and viewing the target from the larger diameter end through the tapered tubular spiral configuration, multiple reflected images of the pattern of the target will be visible along the inner periphery of the spiral configuration to provide novel optical effects.

The invention will be understood more fully, while still further objects and advantages wil become apparent, in the following detailed description of a preferred embodiment of the invention illustrated in the accompanying drawing, in which.

Figure 1:
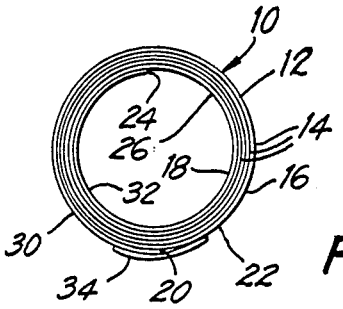
FIG. 1 is a top plan view of a device constructed in accordance with the invention, in a collapsed configuration.
Figure 2:
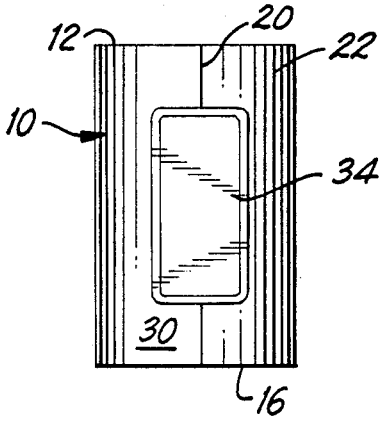
FIG. 2 is an elevational view of the device, in the collapsed configuration.

Referring now to the drawing, and especially to FIGS. 1 and 2 thereof, a device constructed in accordance with the invention is illustrated at 10 and is seen to include an elongate, thin strip 12 of resiliently flexible material wound into a coiled configuration having a plurality of turns 14 which overlap one another in serial contiguous relatonship, from a radially outermost turn 16 to a radially innermost turn 18. A first end 20 of the strip 12 is located on the outer periphery 22 of the coiled configuration, while a second end 24 of the strip 12 is located on the inner periphery 26. The turns 14 are coiled tightly enough so that each previous turn 14 is gripped by the next subsequent turn 14 by friction to retain the turns 14 in position relative to one another and to maintain a stable coiled configuration, such as the retracted position illustrated in FIGS. 1 and 2.

Strip 12 has opposite first and second surfaces 30 and 32, first surface 30 facing radially outwardly and second surface 32 facing radially inwardly with respect to the coiled configuration. Preferably, securing means are provided for holding the tightly coiled arrangement of turns 14 in place, the securing means being illustrated in the form of an adhesive patch 34 overlapping the first end 20 and adhered to the outermost turn 16 to secure the first end 20 in place on the outermost turn 16.

Figure 3:
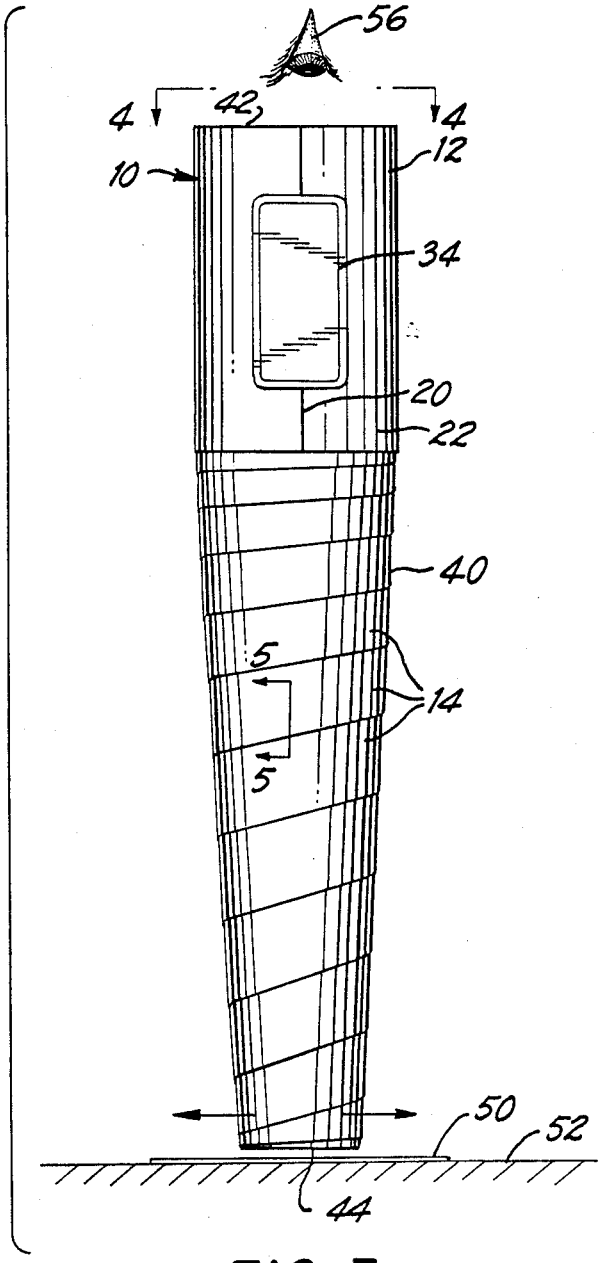
FIG. 3 is a partially diagrammatic elevational view showing the device extended and in use.
Figure 4:
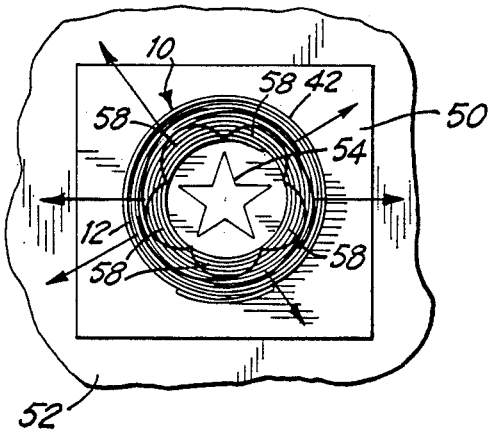
FIG. 4 is a plan view taken along line 4—4 of FIG. 3.

Turning now to FIGS. 3 and 4, by displacing the second end 24 axially relative to the first end 20, strip 12 may be extended into an elongate tubular spiral configuration, shown at 40, having a larger diameter end 42 and a smaller diameter end 44.

In the spiral configuration, the contiguous turns 14 still overlap and grip one another with a frictional force sufficient to maintain stable the erected elongate spiral configuration 40. Strip 12 includes light-reflective means for reflecting light radially inwardly of the spiral configuration such that upon placement of the smaller diameter end 44 adjacent a selected visible target 50, here shown resting upon a support surface 52, the pattern 54 on the target 50 may be viewed from the larger diameter end 42 through the interior of the spiral configuration 40, as illustrated diagrammatically by the eye 56 of a viewer. In this manner, novel optical effects will be available for observation by the viewer, the novel optical effects being in the form of multiple reflected images 58 of the pattern 54 of the target 50 along the inner periphery 26 of the spiral configuration 40. Simultaneous movement of the smaller diameter end 44 relative to the target 50 in directions essentially parallel to the support surface 52, as indicated by the arrows in FIGS. 3 and 4, will tend to scan the pattern 54 and change the viewed display provided by the multiple reflected images 58 in much the same manner as the operation of a kaleidoscope. The effect is amusing and intriguing and provides an entertaining diversion which can be enjoyed by a wide audience of users, ranging from ingenuous children to sophisticated business executives and professionals.

Figure 5:
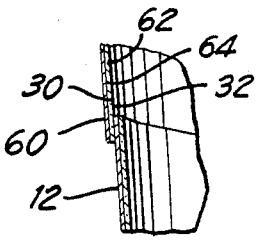
FIG. 5 is an enlarged fragmentary cross-sectional view taken along line 5—5 of FIG. 3.

In the preferred embodiment, the material of the strip 12 is a thin film of synthetic resin material, such as MYLAR, which has the requisite resilient flexible characteristics. Preferably, the material is transparent and the light-reflecting means includes a layer 60 of light-reflecting material on the synthetic resin substrate 62 provided by strip 12, as seen in FIG. 5. In the illustrated embodiment, the layer 60 is placed on the first surface 30 so that the radially inwardly-facing surface 64 of the layer 60 is protected by the material of the strip 12 itself and will remain unmarred for maintaining undistorted the light reflecting capabilities of the layer 60.

When it is desired to store or carry the device 10, the strip 12 merely is retracted to the coiled configuration shown in FIGS. 1 and 2. The device 10 is erected readily to the spiral configuration, shown in FIGS. 3 and 4, when it is desired to place the device into use. The actual manipulations of the strip 12 between the coiled configuration and the spiral configuration provide another source of tactile satisfaction to users of all ages and enables the device 10 to serve further as an amusement and a diversion. The highly reflective finish of the device 10, as provided by layer 60, enhances the appearance of the device and renders the device aesthetically appealing, as well as providing tactile satisfaction.

It is to be understood that the above detailed description of a preferred embodiment of the invention is provided by way of example only. Various details of design and construction may be modified without departing form the true spirit and scope of the invention, as set forth in the appended claims.

The embodiments of the invention is which an exclusive property or privilege is claimed are defined as follows:

1. An amusement device for use in connection with a selected patterned target to enable viewing of the target with novel optical effects, the device comprising:

an elongate, thin strip of resiliently flexible material wound into a coiled configuration having a plurality of overlapping turns extending from a radially innermost turn to a radially outermost turn, an inner periphery along the innermost turn of the coiled configuration and an outer periphery along the outermost turn of the coiled configuration, a first end located along the outer periphery of the coiled configuration, and a second end located along the inner periphery of the coiled configuration;

the strip having opposite first and second surfaces, the first surface facing radially outwardly and the second surface facing radially inwardly such that upon displacement of the second end of the strip axially relative to the first end of the strip the coiled configuration will be elongated axially into an elongate tubular spiral configuration tapered from a larger diameter end at the outermost turn to a smaller diameter end at the innermost turn; and light-reflective means on the strip for reflecting light radially inwardly such that upon placement of the smaller diameter end adjacent the selected target and viewing the target from the larger diameter end through the tapered tubular spiral configuration, multiple reflected images of the pattern of the target will be visible along the inner periphery of the spiral configuration to provide novel optical effects.

2. The invention of claim 1 wherein each subsequent turn of the coiled configuration is contiguous with the next previous turn.

3. The invention of claim 2 wherein the turns are wound tightly enough to maintain each subsequent turn in position axially relative to the respective previous contiguous turn by friction between the contiguous turns.

4. The invention of claim 3 including securing means affixing the first end of the strip to the turn of the coiled configuration contiguous with the first end.

5. The invention of claim 4 wherein the securing means includes an adhesive patch adhered to the outermost turn.

6. The invention of claim 3 wherein the light-reflective means includes a layer of light-reflective material on the material of the strip.

7. The invention of claim 6 wherein the material of the strip is transparent and the layer lies along the first surface of the strip.

8. The invention of claim 7 wherein the material of the strip is a film of synthetic resin material.

9. The invention of claim 1 including securing means affixing the first end of the strip to the turn of the coiled configuration contiguous with the first end.

10. The invention of claim 9 wherein the securing means includes an adhesive patch adhered to the outermost turn.

11. The invention of claim 1 wherein the light-reflective means includes a layer of light-reflective material on the material of the strip.

12. The invention of claim 11 wherein the material of the strip is transparent and the layer lies along the first surface of the strip.

13. The invention of claim 12 wherein the material of the strip is a film of synthetic resin material.

14. The invention of claim 1 wherein the material of the strip is a film of synthetic resin material.

* * * * *